United States Patent [19]

Moates et al.

[11] 4,454,617

[45] Jun. 19, 1984

[54] IMMISCIBLE SEGMENTED DISTRIBUTOR FOR RANDOM DYEING OF TEXTILES

[75] Inventors: Danny Moates, Dalton; Michael L. Chadwick, Calhoun, both of Ga.

[73] Assignee: Celanese Corporation, New York, N.Y.

[21] Appl. No.: 447,040

[22] Filed: Dec. 6, 1982

[51] Int. Cl.[3] ..... D06B 1/06

[52] U.S. Cl. ..... 8/151; 68/205 R; 101/364; 118/325

[58] Field of Search ..... 68/205 R, 200, 202; 118/258, 259, 324, 325; 101/364; 8/151

[56] References Cited

U.S. PATENT DOCUMENTS

| | | | |
|---|---|---|---|
| 3,498,262 | 3/1970 | Hill et al. | 118/259 X |
| 3,541,815 | 11/1970 | Appenzeller et al. | 68/22 R |
| 3,683,649 | 8/1972 | Takriti et al. | 68/5 D |
| 3,701,269 | 10/1972 | Wilcox | 68/19 |
| 3,718,427 | 2/1973 | Ahrweiler | 8/151 |
| 3,726,640 | 4/1973 | Takriti et al. | 8/149 |
| 3,731,503 | 5/1973 | Appenzeller et al. | 68/205 R |
| 3,909,191 | 9/1975 | McCoy | 8/87 |
| 4,146,362 | 3/1979 | Nichols, Jr. | 8/1 XB |
| 4,153,961 | 5/1979 | Cleveland | 68/205 R X |
| 4,254,644 | 3/1981 | Bartlett et al. | 68/205 R |
| 4,264,322 | 4/1981 | Lewis et al. | 8/479 |
| 4,275,683 | 6/1981 | Kutz et al. | 68/205 R X |
| 4,377,080 | 3/1983 | Fox | 68/205 R |
| 4,403,360 | 9/1983 | Finney et al. | 68/205 R X |

FOREIGN PATENT DOCUMENTS

| | | |
|---|---|---|
| 0019035 | 2/1980 | European Pat. Off. . |
| 1288681 | 9/1972 | United Kingdom . |
| 1296725 | 11/1972 | United Kingdom . |

*Primary Examiner*—Philip R. Coe

*Attorney, Agent, or Firm*—Depaoli & O'Brien

[57] ABSTRACT

An apparatus and method are provided for multi-color dyeing of a moving carpet with sharply defined specks forming no pattern from distribution of color, distribution of sizes, distribution of shapes, or attenuation of shapes of the specks. The specks are relatively high-viscosity colored segments in an aqueous immiscible gel mixture which is repeatedly mixed and distributed transversely of the direction of movement of the carpet and then spread into a thin layer by the upper surface of a Kuester roller and finally slid onto the moving carpet.

7 Claims, 4 Drawing Figures

IMMISCIBLE SEGMENTED DISTRIBUTOR FOR RANDOM DYEING OF TEXTILES

BACKGROUND OF THE INVENTION

1. Field of the Invention

This invention relates to multi-color dyeing of textiles and especially relates to such dyeing of carpets with uniformly distributed and sharply defined specks forming no pattern that is created by color, shape, or distribution of the specks thereon.

2. Review of the Prior Art

There are many decorative patterns, currently being applied to many textiles, paper, and other materials by direct printing, discharge printing, silk screen printing, offset printing, and the like, which would be desirable to use on carpets. Marbleizing, veining, and such random visual effects known as segmenting and speckling are examples thereof. These decorative effects range from delicate cobwebs to impressionistic landscapes, but they have long been unavailable to carpet manufacturers. The reason therefor is that it is difficult to obtain sharply defined multicolored print effects or patterns by using randomly dispersed dyestuffs according to prior art methods, because uncontrolled colorant migration and blending cause variations in shading which detract from the appearance of the textile material.

However, a process for achieving attractive multicolor effects on textile materials with improved sharpness, uniformity, and color yield and for applying sharply delineated color patterns on flat or textured or fiber-pile textile materials, substantially without the dyestuff migration that causes secondary and tertiary coloration, has been provided in U.S. Pat. No. 4,264,322, which is assigned to the assignee of this application and the entire contents of which are hereby incorporated herein by reference.

This patent provides a process for producing an aqueous gel composition, comprising an admixture of immiscible gel phases, that is adapted for applying sharply defined multicolor patterns on the surface of an article, such as a carpet. This process comprises: (1) preparing a major quantity of a first aqueous gel phase matrix which is thickened with a cationic gelling agent; and (2) dispersing in the first gel phase matrix a minor quantity of a second aqueous gel phase which is thickened with an anionic gelling agent and which contains a colorant component.

The first aqueous gel phase (i.e., the matrix phase) is present in the composition in a quantity within the range of 60–95 weight percent, and preferably in a quantity of 65–90 weight percent, based on total composition weight. The second aqueous gel phase (i.e., the dispersed phase) is present in the composition in a quantity within the range of 5–40 weight percent, and preferably in a quantity of 10–35 weight percent, based on total composition weight.

Two or more immiscible gel phase of the abovedescribed second type can be dispersed in the matrix phase, wherein each of the dispersed gel phases contains a different colorant so as to provide an aqueous gel vehicle which contains a random distribution of colorant entities. The weight of the two or more dispersed gel phases can total up to about 40 weight percent of the composition.

The matrix gel phase can also contain a colorant component, preferably a dyestuff which is soluble in the matrix gel medium. The matrix gel phase can alternatively contain an anionic gelling agent, instead of a cationic gelling agent; concomitantly, the dispersed gel phase must then contain a cationic gelling agent, instead of an anionic gelling agent. The quantity of cationic or anionic gelling agent incorporated in any one of the aqueous matrix or dispersed gel phases varies within the range of 0.05–3 weight percent, and preferably averages within the range of 0.1–2 weight percent, based on the weight of the individual gel phases.

The term "gelling agent" means a natural or synthetic hydrocolloid which is water-soluble or water-hydratable or water-dispersible, the presence of which is an aqueous medium increases the viscocity of the aqueous medium up to and including a state of gelation.

Illustrative of suitable hydrocolloid cationic gelling agents are hydratable natural and synthetic polymers which contain a multiplicity of quaternary ammonium groups. Typical of quaternary ammonium groups are tetramethylammonium chloride and bromide, benzyltrimethylammonium chloride and bromide, tetraethylammonium chloride and bromide, tetrabutylammonium chloride and bromide, methylpyridinium chloride and bromide, benzylpyridinium chloride and bromide, trimethyl-p-chlorobenzylammonium chloride and bromide, triethylmethylammonium chloride and bromide, and the like, wherein each of the groups is derivatized in the form of a radical which is substituted in a hydrocolloid gelling agent by means of an alkylene or oxyalkylene linkage.

Other hydrocolloids can be employed which contain cationic groups such as acid salts of primary, secondary, and tertiary amines, or which contain phosphonium or sulfonium groups. The anion moiety associated with a cationic group includes halide, sulfate, sulfonate, hydroxide, and the like.

The polymeric structure of suitable hydrocolloid cationic gelling agents include vinyl polymers and copolymers, ion exchange resins, polysaccharides, and the like. A particularly preferred class of hydrocolloids includes derivatized natural gums which contain the appropriate cationic groups. Illustrative of this class of hydrocolloids are polygalactomannan gums containing quaternary ammonium ether and substituents as described in U.S. Pat. No. 4,031,307:

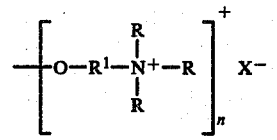

wherein R is an alkyl group containing between one and about six carbon atoms, $R^1$ is an alkylene group containing between one and about six carbon atoms, X is chlorine or bromine, and n is an integer which correlates with the degree of substitution of the quarternary ammonium ether substituents in a polygalactomannan gum cationic gelling agent. The alkyl and alkylene group can contain other atoms such as oxygen, sulfur, and halogen.

The degree of substitution varies within the range of 0.01–3. The term "degree of substitution" means the average substitution of ether groups per anhydro sugar unit in the polygalactomannan gums. In guar gum, the basic unit of the polymer consists of two mannose units with a glycosidic linkage and a galactose unit attached to a hydroxyl group of one of the mannose units. On the average, each of the anhydro sugar units contains three available hydroxyl sites. A degree of substitution of one means that one third of the available hydroxy sites have been substituted with ether groups.

Polygalactomannan gums are polysaccharides composed principally of galactose and mannose units and are usually found in the endosperm of leguminous seeds, such as guar, locust bean, honey locust, flame tree, and the like. Polygalactomannan gums swell readily in cold water and can be dissolved in hot water to yield solutions which characteristically have a high viscosity even at a concentration of 1–1.5 percent.

Guar flour, for example, is composed mostly of a galactomannan which is essentially a straight chain mannan with single membered galactose branches. The mannose units are linked in a 1–4 glycosidic linkage and the galactose branching takes place by means of a 1–6 linkage on alternate mannose units. The ratio of galactose to mannose in the guar polymer is, therefore, one to two. Guar gum has a molecular weight of about 220,000.

Locust bean gum is also a polygalactomannan gum of similar molecular structure in which the ratio of galactose to mannose is one to four. Guar and locust bean gum as supplied commercially usually have a viscosity (at 1% concentration) of around 1000 to 4000 centipoises at 25° C., using a Brookfield Viscometer Model LVF, spindle No. 2 at 6 rpm.

Also suitable are polygalactomannan gums which have been derivatized by substitution of hydroxyl groups with other groups, in addition to the quaternay ammonium-containing ether groups. Generally, the preferred polygalactomannan ether derivatives are those which have a degree of substitution up to about 1.5.

The anionic gelling agent components of these aqueous gel compositions are hydrocolloids which have the same type of basic polymeric structure as disclosed above in the description of the cationic gelling agents, except that in place of a cationic group there is substituted an anionic group such as carboxylic acid, sulfonic acid, sulfate, and the like. Preferred cationic gelling agents include polysaccharides containing carboxyalkyl groups and synthetic polymers and copolymers containing acrylic acid, maleic acid, or benzenesulfonic acid groups, and the like.

The colorants for use in the aqueous gel compositions include the conventional anionic dyes, nonionic dyes, and cationic dyes, alone or in combination with other colorants such as pigments, powdered metals, and the like. A colorant component is present in an immiscible aqueous gel phase in a quantity which can vary from a trace amount up to about 5 weight percent or more. The average quantity of colorant in an aqueous gel phase will vary within the range of 0.1–5 weight percent, based on the weight of aqueous gel phase. A dye colorant normally will be dissolved in the aqueous gel phase, while pigments, powdered metals, and the like are present in the form of a suspension.

Illustrative of a preferred class of colorants are disperse dyes such as are listed under the heading "Disperse Dyes" in Colour Index, 3rd Edition, Volumes 2 and 3, published by The American Association of Textile Chemists and Colorists.

A particularly preferred class of dyestuffs are those identified as acid dyes. A list of commercially available acid dyes is provided in *Textile Chemists and Colorists* (Volume 8, No. 7A, pages 73–78, July 1976), a periodical published by The American Association of Textile Chemists and Colorists.

In general, it is advantageous to employ an anionic dye in an aqueous gel phase which is thickened with an anionic gelling agent, and to employ a cationic dye in an aqueous gel phase which is thickened with a cationic gelling agent.

The method which is used for dispersing a minor quantity of aqueous gel phase in a major quantity of matrix aqueous gel phase determines the resultant colorant pattern in the admixture of immiscible gel phases. Thus, a swirl or marble effect is achieved by dispersing an aqueous gel colorant phase in a matrix phase with low energy stirring, so that the dispersion is not segmented. A distribution of large specks is achieved by dispersing an aqueous gel colorant phase in a matrix phase with medium energy stirring, so that the dispersion is segmented into discrete large-size specks. A distribution of fine specks (e.g., a heather effect) is achieved by dispersing an aqueous gel colorant phase in a matrix phase with high energy stirring, so that the dispersion is segmented into discrete small-size specks.

These immiscible gel compositions of U.S. Pat. No. 4,264,322 are adapted for achieving multicolor pattern effects on rigid or non-rigid surfaces, such as textiles and particularly carpets, when employing conventional printing and coating application techniques and equipment. These immiscible gel systems are capable of providing multicolor styling of carpets which exhibit a unique combination of sharpness, uniformity, and color yield, when the carpets are dye treated in a continuous assembly such as a suitably modified Kuester-Tak apparatus.

The term "textile materials", as employed herein, is meant to include fabrics, fibers, yarns, and the like. Illustrative of textile materials are woven or non-woven fabrics composed of natural or synthetic hydrophobic or hydrophilic fibers and mixtures thereof.

Well known types of fibers include polyamide fibers such as nylon 6, nylon 66, and nylon 610; polyester fibers such as Dacron, Fortrel, and Kodel; acrylic fibers such as Acrilan, Orlon, and Creslan; modacrylic fibers such as Verel and Dynel; polyolefinic fibers such as polyethylene and polypropylene; cellulose ester fibers such as Arnel and Acele; polyvinyl alcohol fibers; natural fibers such as cotton and wool; man-made cellulosic fibers such as rayon and regenerated cellulose; and the like.

The Kuester apparatus, described in U.S. Pat. No. 3,541,815, comprises a dye pan having a roller immersed therein and a doctor blade to pick off the dye and deposit it as a moving film onto the tufts of the carpet as it passes beneath the trailing edge of the doctor blade.

Known modifications of the Kuester apparatus enable selected patterns to be applied to carpets. For example, U.S. Pat. Nos. 3,683,649, 3,726,640, and 3,731,503 describe means for separating the moving film into a plurality of streams which fall through an oscillating comb-like grid of wires which disperse the streams into droplets which are deposited on the continuously moving carpet passing therebeneath. The doctor blade may also be oscillated. In addition, a second dye-dispersing means, in the form of a trough having jet openings in the bottom, may be positioned above the grid and may be simultaneously oscillated on a different frequency.

A multi-color carpet dyeing process is described in U.S. Pat. No. 4,146,362. This process comprises the use of dyes having substantially different viscosities so that the second dye, having a sufficiently lower viscosity than the first dye, is not absorbed thereby when it is dispersed over the second dye. However, all such Kuester-type applications fail to provide sharply delineated colors and a multi-color pattern. Instead, the colors tend to blend to some degree when they overlap or are side by side.

A device that might be used to apply a film of a gel mixture onto a roll and then onto a carpet is described in U.S. Pat. No. 3,701,269, particularly in FIGS. 4 and 5, but the uniform gap formed between the metering blade and the roll would certainly create severe shearing stresses that would markedly distort the viscous segments within the gel mixture.

In U.S. Pat. No. 4,403,360, herein incorporated by reference, assigned to the assignee of this application and to the assignee of U.S. Pat. No. 4,264,322, a modified Kuester device is provided which comprises a dye bath and roller for picking up a gel film (matrix aqueous gel phase of U.S. Pat. No. 4,264,322) from the dye bath, a lengthened and oscillatable doctor blade for scraping the film off the roller to form a sliding blanket on the smooth surface of the doctor blade, a mixing system for colorant gels, and an oscillatable delivery system for dropping the mixed gels onto the sliding blanket and forming a selected pattern which can be viewed and varied until it is acceptable for sliding onto the carpet which is moving a selected small distance beneath the trailing edge of the doctor blade.

The invention of U.S. Pat. No. 4,403,360 may also be defined as a means and method for continuously forming a desired pattern on a smooth surface with any high-viscosity colorant system that incorporates a physical and/or chemical means to prevent blending of the colorants, and then for delivering the patterned mixture onto a continuously moving piece of textile material, such as a carpet. It therefore provides an off-textile means for producing a desired pattern before delivering the pattern to the carpet. This method is particularly adapted for forming swirling patterns, commonly described as "marbleized", in which the veins are selectively attenuated or broadened to produce desired effects.

It has been found, however, that this modified Kuester device is unable to provide speckled patterns having sufficient uniformity as to distribution of colors of the specks, distribution of sizes of the specks, and shape and distribution of shapes of the specks for commercial usage. A particularly troublesome phenomenon has been attenuation and other shape distortions of the normally round specks. Obviously, even a slight concentration or scarcity of specks of any one color, size, or shape creates a pattern that is quite noticeable to the human eye. Therefore, when a randomly dyed and non-patterned carpet is needed, the demands upon the distribution system accordingly become quite severe.

Experimental work has specifically demonstrated the the conventional prior art method of rotating a roller in a pick-up trough filled with a mixture of gel and segmented colors is satisfactory with respect to pickup but produces attentuated specks on a carpet. Unfortunately, such attenuation is quite noticeable to the eye.

Dropping the gel mixture directly onto the lengthened and oscillating doctor blade of U.S. Pat. No. 4,403,360 seemed to produce acceptable non-patterned results on an experimental scale, but commercial experiments quickly demonstrated that there was additionally a patterning tendency, created by attentuation and other shape distortions, that made the product commercially unacceptable. Dropping the gel mixture from a low height directly onto the top of the roller (i.e., directly above its axis) similarly created slight attenuation effects that were displeasingly noticeable only on a large scale but which also created irregularities in distribution that gave the product a definitely non-random appearance.

It is believed that these shape difficulties are related to reverse flows and eddy currents in the upper layers of the gel film and to viscosity differentials within the gel systems. Such differentials are typified by a gel viscosity of 1000 cps and a color viscosity of 4000 cps. However, the gel and the colored segments or specks have substantially the same density.

Results of experimental work are illustrated in prior art FIGS. 1 and 2. Referring to FIG. 1, it is believed that roller surface 17, rotating in direction 19 through a dye bath 13 comprising globular dye segments 15 within trough 11, lifts a gel layer 21 which tends to flow down as currents 23 along its outer surface to return to trough 11. It is believed that segments 15 tend to be attached to roller surface 17 and that these descending currents 23, combined with the force of gravity, tend to cause segments 15 to become attenuated as flattened segments 25.

Referring to FIG. 2, a gel stream 30 is illustrated as falling from a tee of U.S. Pat. No. 4,403,360 upon topmost roller surface 38 which is revolving in direction 39. Globular dye segments 33 in matrix 31 impinge upon roller surface 38 and are believed to become flattened by decelerative forces and by the distortions produced by currents 35.

A method and apparatus for using a modified Kuester device to obtain random speckled dyeing of carpets and other textiles, with respect to color distribution, size distribution, and shape and shape distribution of color segments, is accordingly needed to produce non-patterned speckled products.

SUMMARY OF THE INVENTION

It is therefore an object of this invention to provide a means for randomly distributing color segments for dyeing textiles.

It is another object to provide a means for maintaining the selected size and shape of the distributed segments until the segments are deposited upon the textiles to provide a randomly dyed and non-patterned appearance.

In accordance with these objectives and the principles of this invention, certain improvements to the known Kuester apparatus and to the apparatus disclosed in U.S. Pat. No. 4,403,360 are herein provided that enable the aqueous gel systems disclosed in U.S. Pat. No. 4,324,322 to be applied to carpets for imparting a randomly dyed and non-patterned appearance. These improvements comprise:

A. a primary distribution means for mixing, storing, and uniformly distributing a gel mixture containing immiscible color segments having selected shapes, sizes, and colors within a aqueous gel phase;

B. a plurality of flexible conveying means which are flow connected to the primary distribution means;

C. a linear alignment means to which the conveying means are attached;

D. an oscillating means for longitudinally oscillating the alignment means;

E. an overflow pan having an overflow lip along one edge; and

F. a mounting means which disposes the overflow pan beneath and aligned with the linear alignment means and alongside the Kuester roller so that the overflow lip rides approximately in contact with the top surface of the Kuester roller which is rotatable to pull overflow material away from the edge of the lip.

The primary distribution means is a manifold which is suitably fed by a single conduit connected to a mixing device which receives the gel mixture from a pump which in turn receives the encapsulated colors from other parts of the system which are not a part of this invention. A suitable mixing device is a static mixer. The mixing device is used to obtain specks of a desired size, but it is not a part of this invention. The manifold is stationary. It can be an open trough if provided with means for distributing material along its length. However, it is preferably in the form of a closed header having several sets of distribution points, preferably spaced one inch, 1½ inches, and three inches apart, along its upper surface. Its diameter may be as small as two inches, and its length should be equal to the width of the carpet or other textile being treated.

The conveying means is suitably a plurality of flexible tubes, such as polyethylene tubes, which are flow connected at their inlet ends to the distribution points on the manifold. These tubes are suitably 2½ feet to three feet in length.

The linear alignment means is a rigid, elongated bar, a section of angle iron, or the like. It is at least as long as the manifold and has openings approximately 1½ inches apart into which the delivery tubes are fitted so that their discharge ends are downwardly directed. It is connected to an oscillating means for providing longitudinal oscillation.

The overflow pan has a depth of at least two inches, a length at least equal to the lengths of the manifold and the Kuester roller, and a width (measured in the direction of carpet movement) of about eight inches. It is aligned with the discharge ends of the flexible delivery tubes and disposed therebeneath. It has a lip extending horizontally along one side. Its purpose is to provide a suitable mixing and storing volume for the gel mixture and a liquid surface which is parallel to the axis of the Kuester roller and approximately in horizontal alignment with the top of this roller and above the sidewise extended overflow lip. The Kuester roller, in effect, functions as a dam for the liquid within the overflow pan.

The mounting means for the overflow pan is suitably the conventional Kuester pan, but any device that can support the overflow pan at the proper elevation, location, and alignment is satisfactory.

The invention additionally comprises the Kuester roller, which is in most instances about 6–8 inches in diameter, and the slide or inclined plane described in U.S. Pat. No. 4,403,360. Only about ⅛ of the circumference of the Kuester roller is used in the process of this invention, but this short arcuate distance has an important function.

This function includes pumping the gel mixture and metering its delivery from the overflow lip to the upper edge of the slide. Pumping occurs because the revolving surface of the roller receives a thin layer of the gel mixture, pulls it off the horizontally extending lip, carries it about 45° to the upper edge of the slide, and pushes it downwardly onto the slide. Metering occurs because the rotational speed of the roller controls the quantity of the gel mixture that is pulled from the overflow lip per unit of time. It should be understood, however, that "pulling" the gel mixture is a term that depends upon its viscosity and the revolving velocity of the roller surface.

The entire apparatus therefore comprises the following items, in combination:

A. a manifold into which the gel/segment mixture flows and which is preferably maintained under positive pressure;

B. a plurality of flexible delivery tubes which are flow-connected at their inlet ends to the manifold;

C. a manifold bar to which the delivery tubes are attached so that their discharge ends are directed downwardly;

D. a means for longitudinally oscillating the manifold bar;

E. an overflow pan which is disposed approximately beneath and aligned with the manifold bar and which comprises a sidewise-extending lip along one side;

F. a mounting means for supporting, locating, and aligning the overflow pan to enable the overflow lip to ride in contact with the Kuester roller along approximately its top surface, so that the Kuester roller acts as a dam for the gel mixture within the overflow pan;

G. the Kuester roller which pulls the gel mixture from the overflow lip, moves it arcuately to the upper edge of the inclined plane, and pushes it onto the plane; and H. the inclined plane which receives the gel mixture and delivers it to the textile moving therebeneath.

DESCRIPTION OF THE PREFERRED EMBODIMENT

Figure 1:
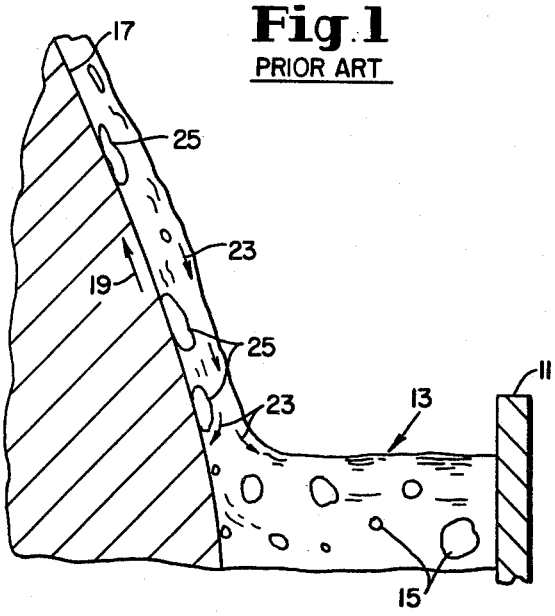
Fig. 1 PRIOR ART
FIG. 1 is a sectional elevational view of a Kuester roller operating within a trough containing an aqueous immobilized gel mixture in which the segments are globular specks and showing attenuation of the specks as the gel mixture is carried upward along the roller surface.
Figure 2:
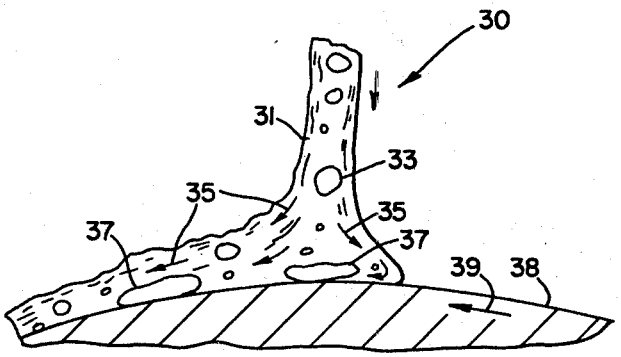
Fig. 2 PRIOR ART
FIG. 2 is a sectional elevational view of a stream falling from a tee overhead onto the revolving surface of the Kuester roller and being revolvingly carried toward an inclined slide as a layer on the roller surface. The globular segments in this gel mixture are illustrated as becoming attenuated upon impact with the surface of the roller.
Figure 3:
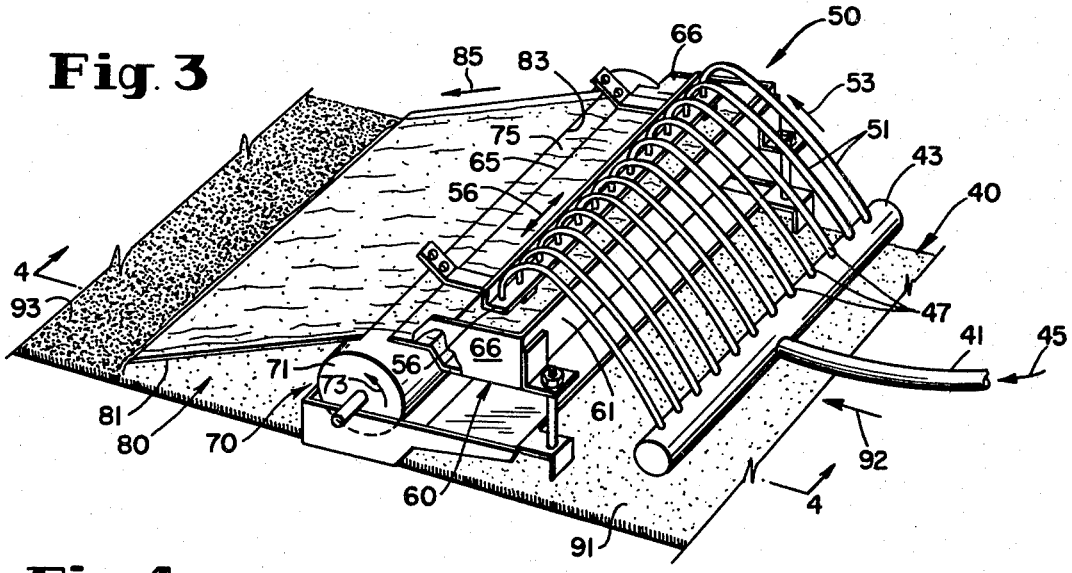
FIG. 3 is a perspective view of a carpet being treated with a modified Kuester device to provide uniformly distributed and sharply defined specks forming no pattern thereon.
Figure 4:
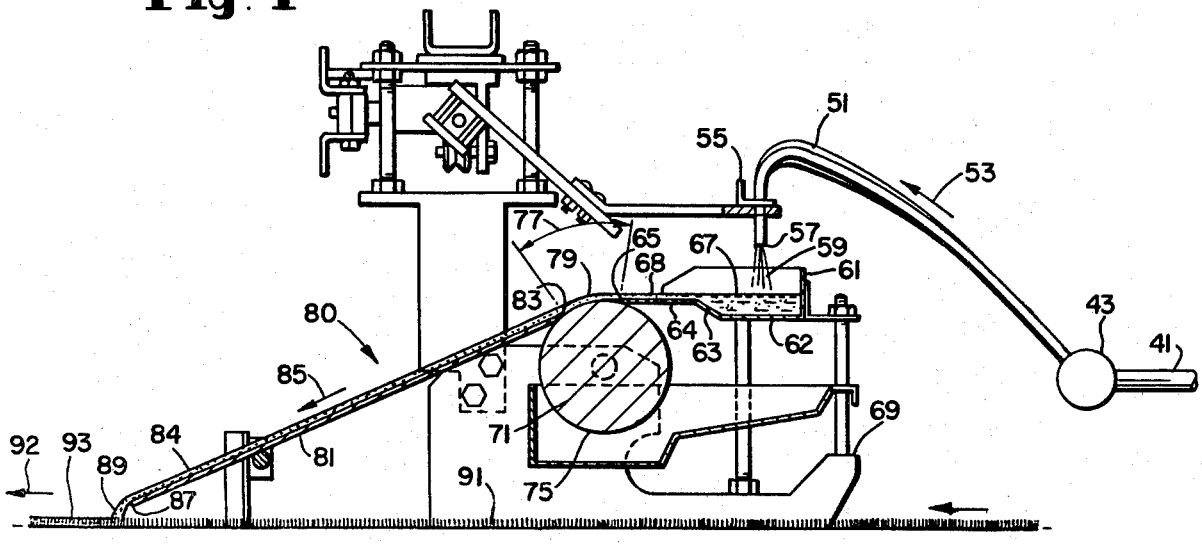
FIG. 4 is a elevational sectional view, looking in the direction of the arrows 4—4 in FIG. 3, of the overflow pan, its support, the Kuester roller, the inclined slide, and the carpet being treated that is shown in FIG. 3.

The modified Kuester device shown in FIGS. 3 and 4 comprises a manifold assembly 40, a conveying, aligning, and oscillating means 50, an overflow pan and support 60, Kuester roller assembly 70, and a slide assembly 80. Carpet 91, passing in direction 92, becomes treated carpet 93 having a uniformly speckled appearance with no semblance of pattern that may have been formed by change of shape of specks, distribution of specks, and/or distribution of color of specks.

Manifold assembly 40 comprises a manifold 43 which is fed by an inlet conduit 41 through which an aqueous immobilized gel mixture 45 is flowing from a pump and a static mixer not shown in the drawing. Along the top of manifold 43 is a row of distribution points 47.

Conveying, aligning, and oscillating means 50 comprises a plurality of flexible tubes 51, which are connected at their inlet ends to distribution points 47, and a manifold bar 55 through which delivery tubes 51 are passed and attached, as seen in FIG. 4. The discharge ends of tubes 51 point directly downwardly and are a short distance above the surface of liquid in the overflow pan therebeneath. The gel mixture is manifold 43 flows in direction 53 through delivery tubes 51 and is discharged from ends 57 as downflowing streams 59.

Overflow pan assembly 60 comprises a rectangular pan having upstream side 61, bottom 62, downstream side 63, extended lip 64, and ends 66. The overflow pan is supported by a typical Kuester pan 69 which is omitted in FIG. 3. The gel mixture which is supplied from downflowing streams 59 within the overflow pan has a surface 68 which evenly covers extended lip 64.

Kuester roller assembly 70 comprises a roller 71 rotating in direction 73 and having a surface 75 upon which lip edge 65 lightly rests. The topmost portion of surface 75 is approximately level with gel surface 68 so that it acts as a dam for the gel mixture. As roller surface 75 revolves away from edge 65, it appears to "pull" the relatively viscous gel mixture from lip edge 65 through arcuate distance 77 as a layer 79.

Slide assembly 80 comprises a lengthened slide 81 which is disposed at an angle of about 30°–40° with upper edge 83 being lightly in contact with roller 71 and with discharge edge 87 being a short distance above carpet 91. Gel layer 79 on roller 71 is pushed onto and over upper edge 83 and onto slide 81 to form layer 84 moving downwardly in direction 85 and falling from discharge edge 87 as falling gel mixture 89 onto untreated carpet 91 to form treated carpet 93 which is moving in direction 92.

Inasmuch as the present invention is subject to many variations, modifications and changes in detail it is intended that all matter that is described hereinbefore or shown in the accompanying drawings be interpreted as illustrative and not in a limiting sense and that the invention be limited in scope only by the accompanying claims.

What is claimed is:

1. In the multi-color continuous dyeing of a moving sheet of textile with sharply defined specks forming no pattern from distribution of colors, distribution of sizes, distribution of shapes, or attenuation of shapes, an off-textile forming means for uniformly distributing an aqueous immiscible gel mixture upon said sheet of textile, comprising:

A. a smooth-surfaced slide which is inclined at an angle of 30°–40° and has a lower discharge edge and an upper edge, said lower discharge edge being vertically spaced from said sheet of textile;

B. a roller, having a cylindrical surface which said upper edge lightly contacts;

C. an overflow pan which comprises a sidewise-extending lip having an edge which lightly contacts said cylindrical surface, said edge of said lip and said upper edge of said slide being arcuately separated by about 40°–50° measured over the top of said cylindrical surface and said overflow pan being adapted to contain said aqueous immiscible gel mixture and to provide a thin layer of said mixture above said sidewise-extended overflow lip, said layer having a liquid surface which is parallel to the axis of said roller and approximately in alignment with the top of said cylindrical surface, whereby said cylindrical surface functions as a dam for said liquid within said overflow pan and revolves from said lip toward said upper edge;

D. a conveying, aligning, and oscillating means for conveying said aqueous immiscible gel mixture to said overflow pan as a plurality of separate streams which are downwardly directed and linearly spaced, for aligning said streams with said overflow pan, and for oscillating said aligned streams; and E. a manifold assembly comprising an inlet conduit, a manifold which contains, distributes, and mixes said gel mixture and which is flow connected to said conveying, aligning, and oscillating means.

2. The off-textile forming means of claim 1, wherein said manifold is closed and under pressure.

3. The off-textile forming means of claim 2, wherein said conveying, aligning and oscillating means comprises:

A. a plurality of flexible tubes, having inlet ends which are flow connected to said manifold;

B. an elongated bar to which said flexible tubes are attached so that the discharge ends of said tubes are downwardly directed, aligned with said overflow pan, and vertically spaced from said overflow pan; and C. an oscillating device which oscillates said elongated bar.

4. The off-textile forming means of claim 3, wherein:

A. said manifold is a horizontally disposed cylinder having sealed ends;

B. said inlet conduit is flow connected to the lower periphery of said cylinder; and C. said flexible tubes are flow connected to the upper periphery of said cylinder.

5. A method for multi-color dyeing of a moving sheet of textile with sharply defined specks by uniformly distributed an aqueous immiscible gel mixture upon said sheet of textile while forming no pattern from distribution of colors, distribution of sizes, distribution of shapes, or attenuation of shapes of said specks, comprising:

A. continuously forming said aqueous immiscible gel mixture containing approximately globular colorant specks;

B. sidewardly distributing said mixture in relation to the direction of movement of said textile;

C. forming a plurality of discharge streams of said distributed mixture which are aligned transversely to said direction of movement and downwardly directed;

D. receiving said plurality of discharge streams within an overflow volume having a liquid surface which is dammed along one transverse edge by a cylindrical surface which is revolving away from said overflow volume and in said direction of movement;

E. forming a thin layer of said gel mixture along one side of said overflow volume and alongside said cylindrical surface;

F. arcuately conveying said thin layer of said gel mixture away from said overflow volume;

G. pushing said thin layer onto the upper edge of an inclined surface which is in contact with said cylindrical surface;

H. sliding said thin layer down said inclined surface; and

I. dropping said thin layer onto said moving sheet of textile.

6. The method of claim 5, wherein said discharge streams are oscillated.

7. The method of claim 5, wherein said textile is a carpet.

* * * * *